US005168311A

United States Patent [19]

Hino

[11] Patent Number: 5,168,311

[45] Date of Patent: Dec. 1, 1992

[54] IMAGE FORMING APPARATUS AND PROCESS FOR FORMING AN IMAGE FOR MAGNETIC END CHARACTER RECOGNITION

[75] Inventor: Takashi Hino, Tokyo, Japan

[73] Assignee: Canon Kabushiki Kaisha, Tokyo, Japan

[21] Appl. No.: 783,938

[22] Filed: Oct. 29, 1991

[30] Foreign Application Priority Data

Oct. 30, 1990 [JP] Japan ..... 2-294257

[51] Int. Cl.[5] ..... G03G 15/09

[52] U.S. Cl. ..... 355/251; 118/658

[58] Field of Search ..... 355/251-253; 346/160, 153.1; 358/300; 118/658; 430/122, 39, 106.6

[56] References Cited

U.S. PATENT DOCUMENTS

| | | | |
|---|---|---|---|
| 4,292,387 | 9/1981 | Kanbe et al. | 430/102 |
| 4,387,664 | 6/1983 | Hosono et al. | 118/658 |
| 4,395,476 | 7/1983 | Kanbe et al. | 430/102 |
| 4,458,627 | 7/1984 | Hosono et al. | 118/657 |
| 4,563,086 | 1/1986 | Knapp et al. . | |
| 4,859,550 | 8/1989 | Gruber et al. | 430/39 |
| 5,034,298 | 7/1991 | Berkes et al. | 430/39 X |
| 5,084,733 | 1/1992 | Katoh et al. | 355/251 |

*Primary Examiner*—Richard L. Moses

*Attorney, Agent, or Firm*—Fitzpatrick, Cella, Harper & Scinto

[57] ABSTRACT

An image forming apparatus for forming an image for magnetic ink character recognition includes an image bearing member, a latent image forming device for forming on the image bearing member an electrostatic latent image corresponding to an image for magnetic ink character recognition and a developing device for developing the electrostatic latent image. The developing means includes a non-magnetic developer carrying member for carrying a one component magnetic developer to a developing zone, and a magnet disposed in the non-magnetic developer carrying member, the magnet forming a magnetic field of 600-1000 Gausses in the developing zone, a container for containing a one component magnetic developer to be supplied to the non-magnetic developer carrying member, wherein the developer contains magnetic toner containing not more than 50% by weight of a magnetic material and has a coercive force of 145-200 Oersted and a residual magnetization of 3.0-5.5 emu/g. A regulating member is provided for regulating a thickness of a layer of the one component developer on the developer carrying member so as to be smaller than a minimum clearance between the image bearing member and the developer carrying member in the developing zone.

5 Claims, 2 Drawing Sheets

IMAGE FORMING APPARATUS AND PROCESS FOR FORMING AN IMAGE FOR MAGNETIC END CHARACTER RECOGNITION

FIELD OF THE INVENTION AND RELATED ART

The present invention relates to a process and apparatus for forming an MICR (magnetic ink character recognition) image. The MICR is stipulated in ANSI X9.27-1988 or in JIS X9002-1980.

As an MICR printer for printing MICR characters, an impact type printer is known in which a tape or the like coated with magnetic ink is pressed onto a sheet of paper or the like by a hammer having a character.

On the other hand, since an electrophotographic process uses magnetic toner particles, it is usable as the MICR printer. The electrophotographic process is advantageous for its low level noise and high speed printing characteristics.

When an electrophotographic printer in the form of a laser beam printer, LED printer or CRT printer or the like is connected with a host computer, not only the MICR characters but also other information can be printed on a check or a bill, including a name or financial institution such as bank, a name of a drawer, a mark of the financial institution, decorations or the like. In other words, almost all of the printing required on the check or the bill can be printed at one time when the check or the bill is issued. Additionally, the host computer can manage all the items such as amounts, kinds, the addresses, the balances and, therefore, the check or bill issuing work is significantly simplified.

In order that the MICR characters are recognized by a reader with certainty, the characters are required to be permanently magnetized to a proper extent. On the other hand, if the degree of permanent magnetization is too high in the magnetic toner, the electrostatic latent image is not properly developed therewith.

In addition, in order to print the proper MICR character, it is desirable that the magnetic toner is triboelectrically charged by friction with a developer carrying member to a satisfactory extent.

Fog in the image is minimized since otherwise the fog may be a cause of a noise or erroneous reading.

SUMMARY OF THE INVENTION

Accordingly, it is a principal object of the present invention to provide a method and apparatus for forming good quality MICR images with magnetic toner through an electrophotographic process.

According to an embodiment of the present invention, an electrostatic latent image is formed on an image bearing member, corresponding to an MICR image to be formed. The latent image is developed with a one component dry magnetic developer not containing carrier particles which are used in a two component developer.

The thickness of a developer layer is smaller than the minimum clearance between the image bearing member and the developer carrying member in the developing zone, and a magnet disposed within the developer carrying member produces a magnetic field of 600–1000 Gauss in the developing zone. This is effective to prevent production of a foggy background.

The effectiveness of preventing a foggy background increases with an increase in the residual magnetization $\sigma_r$ of the toner by the magnetic pole corresponding to the image bearing member in the developing zone where the magnetic field is formed. If, however, the residual magnetization $\sigma_r$ is too large so that the maximum energy multiple $(B \times H)max$ is too large, the MICR output in the reader is excessively large with the result of increased rejection. In addition, development by the toner becomes poor.

According to the inventor's investigations, the residual magnetization $\sigma_r$ of the toner is preferably not more than 5.5 emu/g from the standpoint of providing proper developed image density. It has been further revealed that if the developer carrying member is subjected to a magnetic field not more than 1000 Gausses in the developing zone, the production of fog can be almost completely prevented when the used toner has the residual magnetization in the above-described range. In order that the characters are correctly read by the reader, the residual magnetization of the toner is preferably not less than 3.0 emu/g.

The coercive force is not less than 145 Oersted and not more than 200 Oersed so that the permanent magnetization power of the toner is suppressed to a relatively week level.

The coercive force of the magnetic toner usually employed in the image forming apparatus is 80–100 Oersted. In order to that the characters are correctly read by the reader, it is desirable that the coercive force of the toner used in the MICR printer is not less than 145 Oersted. In order to suppress the permanent magnetization of the toner in the developing device, to a developable minimum level it is desirable that it does not exceed 200 Oersted.

If the magnetic toner particles contain a large quantity of the magnetic material, the charging or charge retaining properties are deteriorated, as described hereinbefore, with the result of poor performance of development. This degrades the print quality and is a cause of insufficient MICR output in the reader (the output for the magnetic recognition from the MICR characters). It has been found that a content of the magnetic material in the toner particles which is not more than 50% by weight can solve this problem. If the residual magnetization of the toner $\sigma_r$ is not less than 3 emu/g, the maximum energy multiple $(B \times H)max$ can be assured so as to provide proper MICR output in the reader.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

For the purpose of simplicity, the following descriptions deal with the case in which the latent image is of the negative polarity, and the magnetic toner is triboelectrically charged to the negative polarity (the same polarity as the latent image) by friction with the developing sleeve (so that the latent image is reverse-developed).

Figure 1:
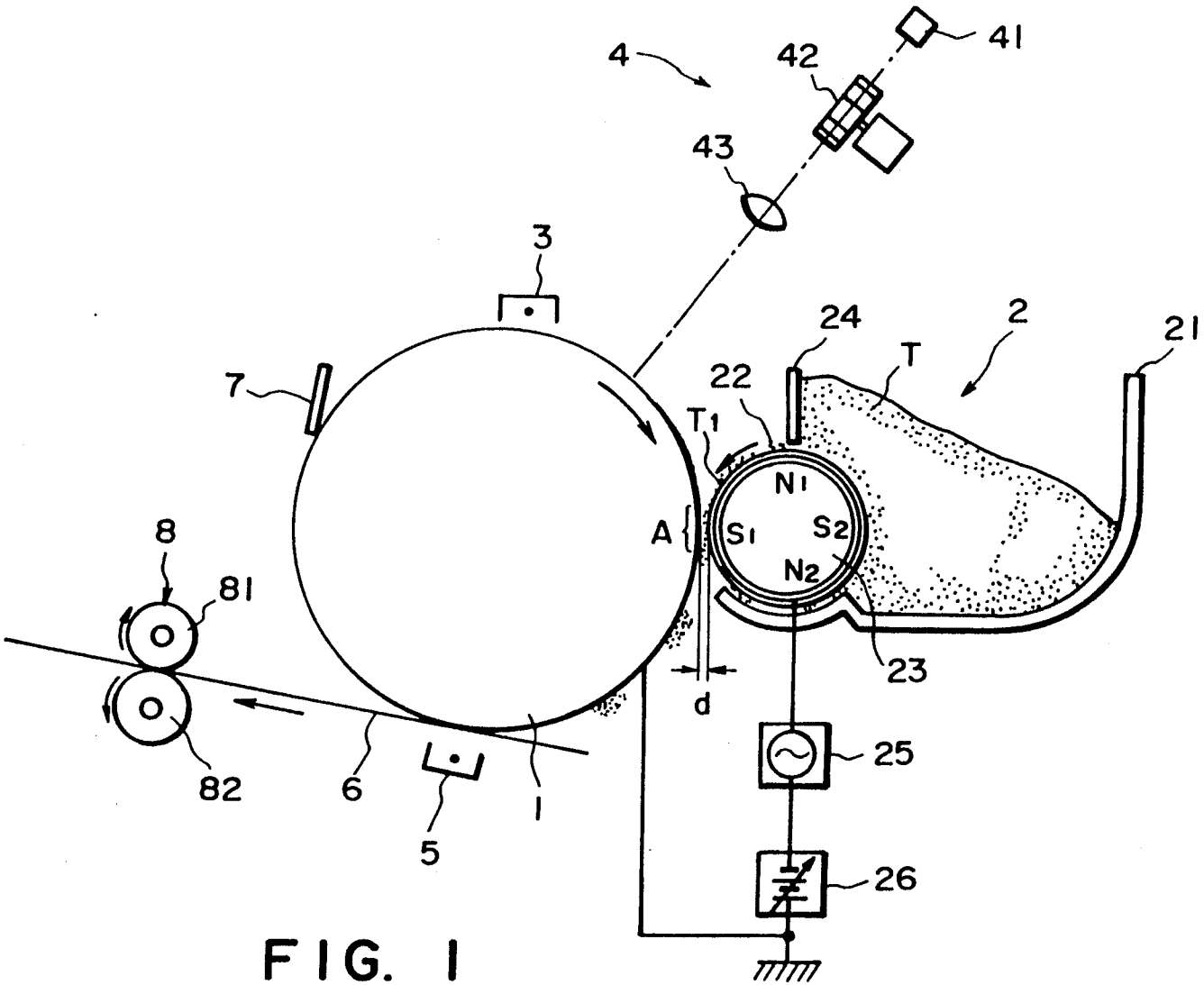
FIG. 1 is a sectional view of a developing apparatus according to an embodiment of the present invention.

Referring to FIG. 1, there is shown an image forming apparatus according to a first embodiment of the present invention. It comprises an electrophotographic photosensitive member in the form of a cylindrical drum 1 rotatable in the direction indicated by an arrow. It comprises a grounded metal drum and a photosensitive layer of an organic photoconductive material, for example.

Around the photosensitive drum 1, there are disposed a charger, an image exposure device 4, a developing device 2, an image transfer device 5 and a cleaning device 7. After image transfer, the residual toner on the surface of the drum 1 is removed by the cleaning device 7. The surface of the drum 1 which has now been cleaned is substantially uniformly charged to a negative polarity by the charger 3. Subsequently, the drum 1 is exposed to an image information beam by exposure device 4, so that an electrostatic latent image is formed.

The exposure device 4 comprises a semiconductor laser 41 driven in accordance with the MICR image signals, a scanner 42 for scanningly deflecting the laser beam emitted in accordance with the signals by the laser 41 and a lens 43 for imaging the laser beam on the drum 1. An electrostatic latent image of the MICR image is formed on the drum 1 by the exposure device. In the electrostatic latent image, an image portion potential (dark portion potential $V_D$) is −150 V, for example; and the potential of the non-image portion (light portion potential $V_L$) is −600 V, for example. The electrostatic latent image is developed by the developing device 2 which will be described in detail hereinafter. The magnetic toner image thus produced is transferred onto a transfer material 6 in the form of a sheet of paper by the image transfer device 5. The transfer material 6 is then fed to an image fixing device 8 comprising an image fixing roller 81 and a pressing or back-up roller 82 press-contacted thereto. The transfer material 6 passes through the nip formed between the rollers 81 and 82, and the magnetic toner image is heated and pressed and therefore fixed on the transfer material 6.

In an MICR reader-sorter, the MICR characters are rubbed with a magnetic head during the reading operation. Therefore, if the print is worn by the repeated reading and/or sorting operations, the MICR character output is reduced. However, using the heating and pressing fixing apparatus is advantageous in that the fused magnetic toner enters between the paper fibers of the transfer material, so that the anti-wearing property of the characters is improved.

The developing device 2 comprises a container 21 for containing an insulative one component magnetic developer T mainly comprising magnetic toner without containing so-called carrier particles, a cylindrical developer carrying sleeve 22 of magnetic material such as stainless steel or aluminum, which is supported on the container 21 and which is rotatable in the direction indicated by an arrow and to which the magnetic toner is supplied from the container 21, a magnet 23 which is stationarily disposed within the sleeve 22, and a regulating blade 24 for regulating a thickness of a layer of the magnetic toner T1 to be carried to the developing zone A.

The blade 24 is made of magnetic material such as iron and is disposed across the sleeve 24 from a magnetic pole N1 of the magnet 23. It functions to regulate the thickness of the toner layer so that the thickness is smaller than the minimum clearance d (300 microns, for example) between the sleeve 22 and the drum 1. Thus, a thin layer of the magnetic toner particles is formed by a strong magnetic field from the magnetic pole N1 concentrated on the blade 24 (U.S. Pat. No. 4,387,664). The thickness of the magnetic toner layer is 160 microns, for example. Because of the dimensional relation between the toner layer thickness and the clearance in the developing zone, a so-called non-contact development is carried out in the developing zone. More particularly, the toner particles jump from the layer of the developer on the sleeve to the drum 1 in the developing zone A including the region in which the minimum clearance is formed between the sleeve 22 and the drum 1 and the regions adjacent thereto.

The sleeve 22 is supplied with an oscillating bias voltage which is provided by the output voltage of a rectangular wave AC source 25, biased with an output voltage of a DC source 26. The AC component of the oscillating voltage has a frequency of 1.5 KHz and a peak-to-peak voltage Vpp of 1.6 KV, for example. The DC voltage component has a level between a light portion potential and a dark portion potential of the latent image. In the example of FIG. 1, the output of the DC source 26 is variable within the range of −200--600 V.

In the developing zone A a transfer electric field in the direction of transfer of the magnetic toner particles from the sleeve 22 to the drum 1, and a back-transfer electric field for directing the toner particles from the drum 1 to the sleeve 22, are repeatedly formed by the electric source. As disclosed in U.S. Pat. Nos. 4,292,387 and 4,395,476, the electric field in the transfer phase is effective to move the toner to the drum 1, and the electric field in the back-transfer phase is effective to release the toner from the drum 1 and to move it back to the sleeve 22. In other words, the toner particles are reciprocated by the oscillating electric field. The quantity of the toner particles transferred to the drum and the quantity of the toner particles transferred back to the sleeve are different in the image portion than in the non-image portion. As the clearance between the drum 1 and the sleeve 22 increases, the strength of the electric field therebetween becomes weaker, and the developing action is completed, since the quantity of the toner that remains on the drum 1 is determined in accordance with the potential of the latent image, so that a toner image is provided.

The magnet 23 forms a magnetic field in the developing zone A and comprises a magnetic pole S1, which contributes to reduction of fog toner or scattering of the toner and magnetic poles N2 and S2, which attract the toner T in the container 21 onto the surface of the sleeve 22. In this example, the developing pole S1 faced to the drum 1 through the sleeve in the developing zone provides 850 Gausses on the surface of the drum 1.

As described in the foregoing, the magnetic toner particles are triboelectrically charged mainly by the friction between the toner and the sleeve 22 to such an extent as to develop the latent image. The polarity is negative in this example.

In the apparatus described in the foregoing, a magnetic toner (Example 1) is used which has a coercive force of 167 Oersted, a residual magnetization of 4.52 emu/g, and a magnetic material content of 37.5% by weight in the resin binder. The toner particle included 0.5% by weight of hydrophobic collodial silica.

MICR characters were actually printed with different DC voltage from the source 26, more particularly, −250 V, −400 V and −550 V.

The printed sample check was completely free from fog toner and had sufficient image density of approximately 1.32. The variation in the density in the entire width of the sample check was less than 0.05. The variation of the width of a line image having a width of not less than 50 microns, had a variation of approximately ±10 microns. The MICR characters thus printed were read by a reader, the outputs were approximately 110% (the DC component of −400 V), 170% (−550 V) and 70% (−250 V) with the second and third peak levels in the stipulated output of ON-US symbol being 100%. These results satisfy the requirement of not less than 50%.

Sorting test (50 times) were carried out using a commercially available MICR sorter, available from IBM. The rejection ratio was 0.9% (DC component voltage of −400 V), 2.5% (−250 V) and 0.1% (−550 V).

EXAMPLES 2-9

The same tests were carried out in which only different toners are used. The same results were obtained as in the Example 1. The results of Examples 1-9 are shown in Table 1.

TABLE 1

| Examples | Coercive (Oersted) | Residual Mag. (emu) | Mag. Mat. Content (%) | Image Density (DC Comp: −400 V) | Variation in Width Direction: Density | Variation in Width Direction: Line Width (μm) | Characteristic −250 V: Output (%) | Characteristic −250 V: Rejection (%) | Characteristic −400 V: Output (%) | Characteristic −400 V: Rejection (%) | Characteristic −550 V: Output (%) | Characteristic −550 V: Rejection (%) |
|---|---|---|---|---|---|---|---|---|---|---|---|---|
| 1 | 167 | 4.52 | 37.5 | 1.32 | 0.05 | 10 | 70 | 2.5 | 110 | 0.9 | 170 | 0.1 |
| 2 | 148 | 3.92 | 37.5 | 1.38 | 0.04 | 11 | 60 | 2.8 | 100 | 0.9 | 135 | 0.4 |
| 3 | 186 | 5.4 | 37.5 | 1.36 | 0.05 | 10 | 90 | 0.9 | 130 | 0.4 | 200 | 0.1 |
| 4 | 198 | 3.0 | 37.5 | 1.42 | 0.05 | 10 | 105 | 0.8 | 150 | 0.2 | 200 | 0.1 |
| 5 | 167 | 5.5 | 48.5 | 1.24 | 0.06 | 9 | 75 | 2.0 | 125 | 0.5 | 180 | 0.1 |
| 6 | 148 | 5.0 | 48.5 | 1.25 | 0.05 | 10 | 70 | 2.4 | 109 | 0.8 | 180 | 0.1 |
| 7 | 198 | 5.5 | 48.5 | 1.29 | 0.04 | 9 | 130 | 0.4 | 170 | 0.1 | 200 | 0.4 |
| 8 | 146 | 3.0 | 26.0 | 1.41 | 0.06 | 11 | 60 | 2.8 | 90 | 0.9 | 130 | 0.1 |
| 9 | 159 | 4.6 | 37.5 | 1.28 | 0.05 | 10 | 70 | 2.5 | 120 | 0.7 | 175 | 0.1 |

In Table 1, the rejection ratios are the results in the 50 sorting test. Although not shown in Table 1, the MICR characters were free from problems such as magnetic coagulation of the toner particles in any of Examples 1-9.

COMPARATIVE EXAMPLES 1-9

The same tests were carried out with the exception that the magnetic properties of the toner were outside of the present invention. The results are shown in Table 2.

TABLE 2

| Comp. Examples | Coercive (Oersted) | Residual Mag. (emu) | Mag. Mat. Content (%) | Image Density (DC Comp: −400 V) | Variation in Width Direction: Density | Variation in Width Direction: Line Width (μm) | Characteristic −250 V: Output (%) | Characteristic −250 V: Rejection (%) | Characteristic −400 V: Output (%) | Characteristic −400 V: Rejection (%) | Characteristic −550 V: Output (%) | Characteristic −550 V: Rejection (%) |
|---|---|---|---|---|---|---|---|---|---|---|---|---|
| 1 | 127 | 3.2 | 37.5 | 1.19 | 0.05 | 10 | 30 | 5.6 | 70 | 2.5 | 100 | 0.9 |
| 2 | 118 | 4.4 | 37.5 | 1.25 | 0.05 | 10 | 30 | 4.9 | 60 | 2.8 | 100 | 0.9 |
| 3 | 148 | 5.7 | 48.5 | 1.15*1 | 0.06 | 10 | 70 | 1.0 | 90 | 0.9 | 100 | 0.8 |
| 4 | 130 | 5.9 | 37.5 | 1.20*1 | 0.06 | 10 | 160 | 1.8 | 80 | 1.4 | 120 | 0.6 |
| 5 | 198 | 5.5 | 57.5 | 1.00*1 | 0.05 | 10 | 40 | 5.5 | 60 | 5.0 | 90 | 4.3 |
| 6 | 220 | 4.0 | 37.5 | 1.00*2 | 0.62 | 30 | 30 | 5.6 | 60 | 2.9 | 90 | 0.9 |
| 7 | 180 | 2.6 | 48.5 | 1.35*3 | 0.08 | 12 | 100 | 1.0 | 120 | 0.6 | **1 | |
| 8 | 90 | 3.8 | 48.5 | 0.98 | 0.06 | 10 | 20 | 19.3 | 30 | 6.8 | 30 | 7.0 |
| 9 | 250 | 5.0 | 37.5 | 1.10*2 | 0.46 | 50 | 40 | 6.6 | 60 | 2.6 | 90 | 0.8 |

*1: Remarkable image roughness.
*2: Toner coaggulation.
*3: Remarkable fog.
**1: Many erroneous reading due to fog. Rejection: ≧10%

If the magnetic characteristics of the toner are beyond the conditions according to the present invention, the produced MICR images have low image densities, or the images are coarse or rough. Particularly when the image density is low, the recognition of the MICR characters by the reader is poor, and the deterioration by 50 sorting tests is remarkable. The image density increases with increase of the coercive force of the toner. However, the fog toner also increases; the toner is magnetically coagulated in the developing device. The coagulated toner may be packed at the regulating blade with the result of a decrease of in the image density or a variation in the direction of the width.

The image density lowers with an increase in the residual magnetization. However, if it is lowered, the fog toner increases even to such an extent that the image is unusable as the MICR characters. If the magnetic material content exceeds 50%, the amount of triboelectric charge lowers with the result of low image density as the MICR characters also as the usual print.

It is efficient to apply the magnetic field in the developing zone from the standpoint of prevention of fog toner deposition. The fog preventing effect works when the magnetic field is not less than 600 Gausses. Then, the MICR characteristics given in Table 1 can be provided. However, exceeding a magnetic field of 1000 Gausses should be avoided, since then permanent magnetization of the toner is promoted, and the magnetic coagulation of the toner particles occurs during development.

If the MICR characters on a print, such as a check or the like, is non-uniform due to the non-uniformity of the toner quantity, the magnetic recognition output (MICR output) from the MICR characters is not uniform, with the possible result of erroneous recognition or recognition failure which leads to reject.

However, if the magnetic doctor blade 24 is used for formation of the toner layer, the magnetic toner T behind the blade 24 is uniformly drawn out by the rotation of the non-magnetic developing roller 22 and is uniformly deposited on the developing roller 22 in the form of a layer of the toner T of a small thickness. Then, a layer of the developer is conveyed to the developing zone A where it is faced to the latent image bearing member 1.

The toner layer thus formed has a stable and uniform thickness, and therefore, the toner supply method is most suitable to the development of the MICR characters.

Figure 2:
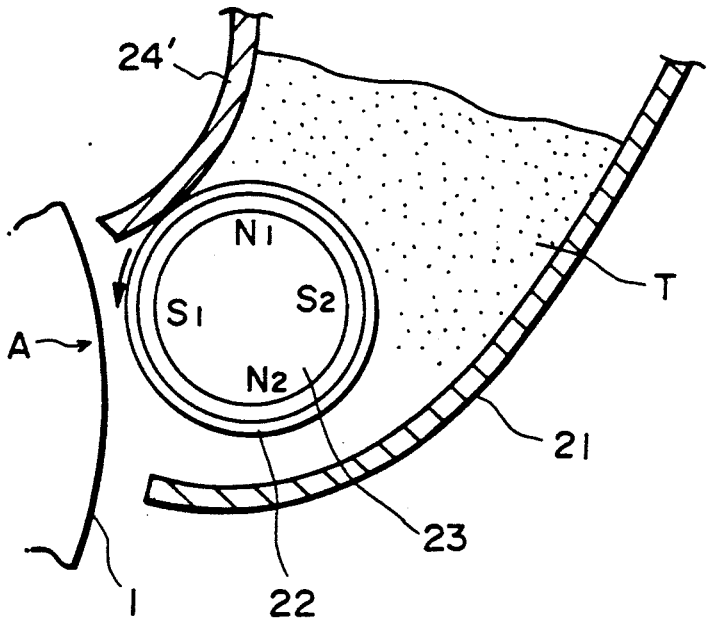
FIG. 2 is a sectional view of an image forming apparatus according to another embodiment of the present invention.

As shown in FIG. 2, formation of the magnetic toner layer may be accomplished by a non-magnetic elastic blade 24' made of an elastic material such as rubber, or a thin metal plate, which is elastically contacted to the sleeve 22. In this case, the toner layer is thin and uniform, and therefore, the method is advantageous for the formation of the MICR image (U.S. Pat. No. 4,458,627).

Additional tests were carried out using a non-magnetic doctor blade having a shape similar to the doctor blade 24. It has been found that no thin layer was formed by the use of the non-magnetic doctor blade. The image density variation in the direction of a width of a check sample was 0.3–0.7 which is significantly large. With this variation of the image density, it is not possible to maintain the non-contact state between the toner layer and the latent image bearing surface of the photosensitive member, and the resultant image had a significantly foggy background.

As a measure against the wearing of the MICR characters due to repeated rubbing by the reading head of the reader, it is preferable that the initial MICR output from the formed MICR characters is higher than that stipulated by JIS or ANSI standard by not less than 30%. More particularly, assuming that the second and third peaks of the ON-US symbol are 100%, it is preferable that the initial output is not less than 130%.

In order to accomplish this, the coercive force of the toner is not less than 145 Oersted, and the residual magnetization is not less than 3.0 emu/g. In addition, the DC voltage level of the DC component of the developing bias voltage applied to the sleeve 22 is adjustable in the foregoing embodiment. By adjusting the bias voltage, the quantity of the toner deposited on the latent image is adjustable. Thus, the image density of the developed image is adjustable, and therefore, the MICR characters having the above-described output level upon the reading, can be easily provided, as required.

As for the method of controlling the image density, there are other methods such as control of the light quantity of the image exposure, control of the clearance between the sleeve and the drum, control of the clearance between the doctor blade and the sleeve, or the like. In any method, it is preferable that the amount of developing power is controlled, to control the image density so as to provide an output which is not less than 1.3 multiplied by the stipulated output, from the standpoint of the durability of the MICR characters.

The magnetic materials to be dispersed in the resin binder of the magnetic toner include a ferrite containing a bivalent metal such as Mn, Zn, Cu, Ni, Co, Fe or the like. One of ordinary skill in the art may properly select the ingredients and sintering conditions to provide the magnetic material for the magnetic toner usable with the present invention. As for the binder resin for the toner, heat curable resin materials used as binder resin materials for the toner used with ordinary copying machines and printers such as polyethylene resin or polyester resin materials, are usable. A magnetic toner, similarly to the toner used with the ordinary copying machines or printers, has a particle size of generally 1–30 microns, and the average particle size measured by microscope is 10–18 microns.

The one component magnetic toner powder may contain a small amount of fine silica particles for the purpose of abrasion cleaning the photosensitive member or for the purpose of increasing fluidity.

As described in the foregoing, according to the present invention, an electrostatic latent image is formed on an image bearing member, corresponding to the MICR image, and the electrostatic latent image is developed with a one component magnetic developer through a non-contact type developing process. In the developing zone, a magnetic field of 600–1000 Gausses is formed by a magnet disposed within the developer carrying member. The toner of the one component magnetic developer contains not more than 50% by weight of magnetic material, and has a coercive force of 145–200 Oersted and residual magnetization of 3.0–5.5 emu/g. By doing so, the resultant MICR image is free from problems such as insufficient development attributable to the permanent magnetization of the toner, poor developing power attributable to the decrease of the triboelectric charge, and foggy background. Therefore, the MICR image can be magnetically read without error.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus for forming an image for magnetic ink character recognition, comprising:

an image bearing member;

latent image forming means for forming on said image bearing member an electrostatic latent image corresponding to an image for magnetic ink character recognition;

developing means for developing the electrostatic latent image, said developing means including a non-magnetic developer carrying member for carrying a one component magnetic developer to a developing zone, a magnet disposed in said non-magnetic developer carrying member, said magnet forming a magnetic field of 600–1000 Gausses in the developing zone, a container for containing a one component magnetic developer to be supplied to said non-magnetic developer carrying member, wherein said developer contains a magnetic toner containing not more than 50% by weight of a magnetic material and has a coercive force of 145–200 Oersted and a residual magnetization of 3.0–5.5 emu/g; and a regulating member for regulating a thickness of a layer of the one component developer on said developer carrying member so as to be smaller than a minimum clearance between said image bearing member and said developer carrying member in the developing zone.

2. An apparatus according to claim 1, further comprising a voltage source for applying an oscillating bias voltage to said developer carrying member.

3. An apparatus according to claim 2, further comprising control means for controlling the oscillating bias voltage.

4. An apparatus according to any one of claims 1-3, wherein said magnet is stationary, and wherein said regulating member is disposed corresponding to one of plural magnetic poles of said magnet and is spaced from said image bearing member, said regulating member including a magnetic member.

5. An apparatus according to any one of claims 1-3, wherein said regulating member is elastically contacted to said developer carrying member.

* * * * *

UNITED STATES PATENT AND TRADEMARK OFFICE

CERTIFICATE OF CORRECTION

PATENT NO. : 5,168,311

DATED : December 1, 1992

INVENTOR(S) : Takashi HINO

It is certified that error appears in the above-indentified patent and that said Letters Patent is hereby corrected as shown below:

On the Title page, item [54]:

"END" should read --INK--.

COLUMN 1

Line 3, "END" should read --INK--.

COLUMN 2

Line 21, "200 Oersed" should read --200 Oersted--.
Line 23, "week" should read --weak--.

COLUMN 4

Line 30, "source." should read --sources.--.

COLUMN 5

Table 2, "Coercive (Oersted) 127" should read --Coercive (Oersted) 120--.

COLUMN 6

Line 43, "is" should read --are--.

UNITED STATES PATENT AND TRADEMARK OFFICE

CERTIFICATE OF CORRECTION

PATENT NO. : 5,168,311

DATED : December 1, 1992

INVENTOR(S) : Takashi HINO

It is certified that error appears in the above-indentified patent and that said Letters Patent is hereby corrected as shown below:

COLUMN 7

Line 28, "had" should read --has--.

Signed and Sealed this

Tenth Day of August, 1993

*Attest:*

Michael K. Kirk

MICHAEL K. KIRK

*Attesting Officer*

*Acting Commissioner of Patents and Trademarks*